US007385560B1

(12) United States Patent
Maloratsky et al.

(10) Patent No.: US 7,385,560 B1
(45) Date of Patent: Jun. 10, 2008

(54) AIRCRAFT DIRECTIONAL/OMNIDIRECTIONAL ANTENNA ARRANGEMENT

(75) Inventors: Leo G. Maloratsky, Indialantic, FL (US); Andrew M. Vesel, Indialantic, FL (US); Joseph M. Strenecky, Melbourne, FL (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 11/527,353

(22) Filed: Sep. 26, 2006

(51) Int. Cl.
*H01Q 1/28* (2006.01)

(52) U.S. Cl. ..... 343/705

(58) Field of Classification Search ..... 343/705, 343/751, 826, 853, 833, 834, 708
See application file for complete search history.

(56) References Cited

U.S. PATENT DOCUMENTS 5,039,994 A * 8/1991 Wash et al. ..... 343/813
5,191,349 A 3/1993 Dinsmore et al. ..... 343/751
5,231,413 A * 7/1993 Dubois ..... 343/833
5,952,976 A * 9/1999 Giacino et al. ..... 343/705
6,313,783 B1 * 11/2001 Kuntman et al. ..... 342/32
6,570,540 B2 * 5/2003 Desargant et al. ..... 343/705
6,664,938 B2 * 12/2003 Strickland ..... 343/895
6,856,295 B2 * 2/2005 Desargant et al. ..... 343/705
6,999,022 B1 * 2/2006 Vesel et al. ..... 342/30

OTHER PUBLICATIONS

U.S. Appl. No. 11/527,355 "Switched Beam Forming Network For An Amplitude Monopulse Directional And Omnidirectional Antenna" by Inventors Leo G. Maloratsky et al.

* cited by examiner

*Primary Examiner*—Huedung Mancuso
(74) *Attorney, Agent, or Firm*—Nathan O. Jensen; Kyle Eppele

(57) ABSTRACT

A directional/omnidirectional antenna system is disclosed. A first printed circuit board has capacitive hats disposed thereon. Each capacitive hat is in association with one of an array of folded monopoles. A second printed circuit board has a switched beam forming network formed thereon. The switched beam forming network is configured to provide a predetermined omnidirectional antenna operation at a first switching position, and a predetermined directional antenna operation at a second switching position. Each of a plurality of feeding elements is associated with one of the folded monopoles. Each feeding element is coupled to one of the capacitive hats and to an antenna terminal. Shorting elements of the folded monopoles are coupled to the capacitive hats and to a ground plate of the antenna. A plurality of decoupling elements improve the antenna pattern for directional and omnidirectional modes and provide greater antenna gain.

19 Claims, 9 Drawing Sheets

AIRCRAFT DIRECTIONAL/OMNIDIRECTIONAL ANTENNA ARRANGEMENT

RELATED INVENTIONS

This application is related to co-pending and commonly owned U.S. application Ser. No. 11/527,355, "Switched Beam Forming Network For An Amplitude Monopulse Directional And Omnidirectional Antenna," filed on an even date herewith, the subject matter of which is incorporated by reference herein in its entirety.

FIELD OF THE INVENTION

The invention relates to antennas, and more particularly, to antennas having omnidirectional and directional antenna radiation patterns.

BACKGROUND OF THE INVENTION

FIG. 1 illustrates an exploded view of a directional antenna 100 from U.S. Pat. No. 5,191,349 "Apparatus and method for an amplitude monopulse directional antenna", which is incorporated by reference herein in its entirety. Directional antenna 100 includes a radome assembly 101, a ground plate assembly 102, a base plate 103, and an adapter plate 104. The radome 105 is manufactured from a polyethersulfone resin having various structures formed on an interior surface, including fastening posts 106, internally threaded grounded portions 107 of the monopole antenna elements, and free portions 108 of the monopole antenna elements. Monopole antenna portions 107 and 108 are coated with copper directly on the surfaces thereof. Capacitors 109 are formed directly on the interior surface of radome 105. Upon assembly, copper coated antenna portions 107 and 108 contact capacitors 109 to form folded monopole antenna elements. Ground plate assembly 102 includes a conducting plate 110. A beam forming network (BFN) is formed on a circuit assembly 111, which is described in detail in the previously mentioned '349 patent. Circuit assembly 111 includes passages 112 providing clearance for free antenna elements 108 to extend through conducting plate 110 and through circuit assembly 111. Connectors 113 electrically couple the aircraft processing and signal generating apparatus (not shown) to the BFN on circuit card assembly 111.

The main disadvantage of this amplitude monopulse directional antenna for use in a communications system configured for Traffic Collision and Aviodance System (TCAS), Transponder, and Universal Access Transceiver (UAT) communications is the difficulties of the omnidirectional mode because of the amplitude and phase differences of the transmission path between the channels and between antenna cables. To eliminate these errors, a special calibration network with variable phase shifters, phase detectors, and an additional calibration signal source is required. Another disadvantage of this antenna is low efficiency due to the strong mutual coupling between the diagonal and adjacent inputs/outputs of the BFN. Experimental testing of the directional antenna disclosed in the '349 patent show 4.1 dB parasitic coupling between diagonal input/output ports at 1090 MHz, and therefore only 61% efficiency. The strong parasitic coupling can be explained by the strong mutual coupling between antenna monopoles and by poor matching between the BFN and the antenna monopoles because the matching network described in the above patent is a one-step quarter wavelength transformer with a narrow frequency band. Combining the narrow-band transformer and the narrow-band 4×4 hybrid matrix with two-branch 90-degree hybrids causes the total narrow band frequency range of the prototype antenna. Therefore, this antenna is not acceptable for the high efficiency combined TCAS/Transponder/UAT system with a frequency range of 978 MHz-1090 MHz or 10.8% bandwidth. A further disadvantage of antenna 100 is that it consists of three metal plates: ground plate assembly 102, base plate 103, and adapter plate 104. The three metal plates therefore mean the antenna is bulky, heavy, and expensive to build.

It is therefore an object of the invention to provide a directional/omnidirectional antenna arrangement having improved performance over existing aircraft antennas while solving the attendant problems of known antennas.

It is another object of the invention to provide a directional/omnidirectional antenna system that minimizes the amount of base metal plates required therefor.

A feature of the invention is an array of folded monopoles coupled to a switched beam forming network.

Another feature of the invention is the feeding and shorting elements associated with each of the folded monopoles are strips formed on a hollow cylindrical dielectric element.

An advantage of the invention is that the number of metal base plates in the antenna system is minimized.

Another advantage is that the size and weight of the antenna system is minimized.

SUMMARY OF THE INVENTION

The invention overcomes the limitations of the art by providing an antenna with directional and omnidirectional operations for receiving and transmitting signals of TCAS, Transponder and UAT systems without a complicated phase calibration network. Also, the present invention provides more antenna efficiency, less antenna weight, and lower cost.

The invention provides an antenna comprising an array of folded monopoles coupled to a switched beam forming network (SBFN). This network provides directional and omnidirectional operations for this antenna. The antenna includes a metal base plate, vertical feeding and shorting elements, a first printed circuit board with four capacitive hats provided thereon, a dielectric radome, a second printed circuit board with the SBFN and broadband matching elements configured thereon, decoupling elements and four electrical connectors. In one embodiment the feeding and shorting strips of the folded monopoles are formed on a hollow dielectric cylinder.

The invention also provides an antenna system configured for selective directional and omnidirectional operation. The antenna system includes an array of folded monopoles. A first printed circuit board has capacitive hats disposed thereon. Each capacitive hat is in association with a folded monopole of the array of folded monopoles. The capacitive hats are formed by a coating on a dielectric substrate. A second printed circuit board has a switched beam forming network and broadband matching network formed thereon. The switched beam forming network is configured to provide a predetermined omnidirectional antenna operation at a first switching position of the switched beam forming network and an activation of only one input/output port of the switched beam forming network, and a predetermined directional antenna operation at a second switching position of the switched beam forming network and an alternate activation of all inputs/output ports of the switched beam forming network. A ground plate provides structural support for the switched beam forming network and an antenna radome. Each of a plurality of feeding elements is associated with each monopole of the array of folded monopoles. Each feeding element is coupled to one of the capacitive hats and an antenna terminal of the switched beam forming network. Shorting elements of the folded monopoles are coupled to the capacitive hats and to the ground plate. A broadband matching network is disposed between the folded monopoles and the input/output ports to provide matching therebetween. A plurality of decoupling elements improve the antenna pattern for both directional and omnidirectional modes and provide greater antenna gain.

The invention also provides an aircraft antenna system configured for selective directional and omnidirectional operation. The antenna system includes an array of folded monopoles. A first printed circuit board has capacitive hats disposed thereon. Each capacitive hat is in association with a folded monopole of the array of folded monopoles. A second printed circuit board has a switched beam forming network formed thereon. The switched beam forming network is configured to provide a predetermined omnidirectional antenna operation at a first switching position of the switched beam forming network and an activation of only one input/output port of the switched beam forming network, and a predetermined directional antenna operation at a second switching position of the switched beam forming network and an alternate activation of all inputs/output ports of the switched beam forming network. Each of a plurality of feeding elements is associated with each monopole of the array of folded monopoles. Each feeding element is coupled to one of the capacitive hats and an antenna terminal of the switched beam forming network. Shorting elements of the folded monopoles are coupled to the capacitive hats and to a ground plate of the antenna system. The ground plate provides structural support for the switched beam forming network and an antenna radome.

The invention further provides an antenna system configured for selective directional and omnidirectional operation. The invention includes: means for providing a plurality of folded monopoles; means for connecting a capacitive hat to each of the plurality of folded monopoles; means for providing an omnidirectional antenna radiation pattern and a directional antenna radiation pattern; means for selectively switching between the omnidirectional antenna radiation pattern and the directional antenna radiation pattern; means for associating an antenna terminal feeding element with each folded monopole and the respective capacitive hat; means of decoupling elements; means of broadband matching network between folded monopoles and inputs/outputs of the switched beam forming network, and ground plate means for providing structural support for the switched beam forming network and an antenna radome.

DETAILED DESCRIPTION OF THE DRAWINGS

Figure 1:
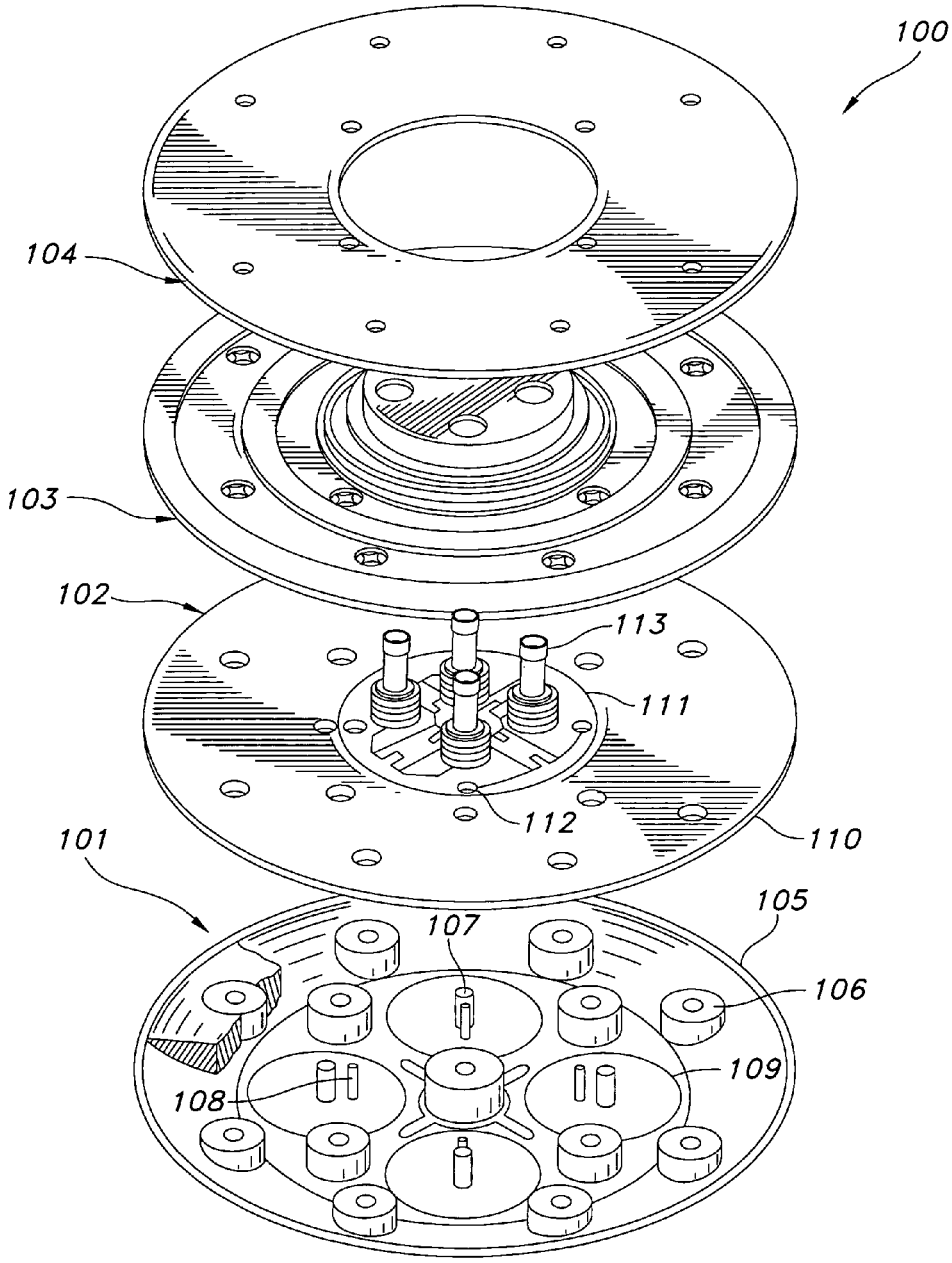
FIG. 1 (PRIOR ART)
FIG. 1 illustrates an exploded view of the antenna of the prior art.
Figure 2:
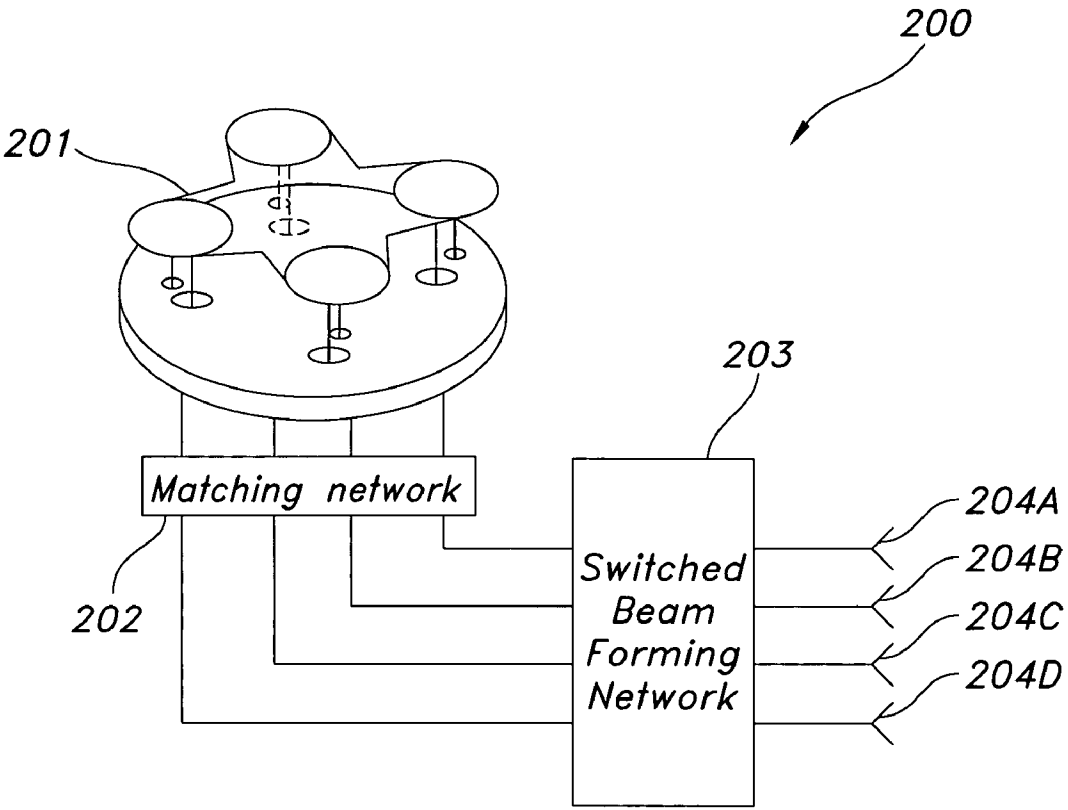
FIG. 2 is a functional block diagram illustrating the operation of the antenna with switched beam forming network according to the invention.

FIG. 2 illustrates a functional block diagram 200 representing the operation of an antenna 201 with a switched beam forming network (SBFN) 203 according to the invention. Transmit signals from a Transponder, a Traffic Collision Avoidance System (TCAS) (for suppression pulse P2) or a Universal Access Transceiver (UAT) (not shown) passes through only one input/output port 204A or 204D of SBFN 203 with a 180-degree phase shifter (see reference number 713, FIG. 7), through a broadband matching network 202 to antenna 201. Such transmit signals have an omnidirectional antenna radiation pattern because the four antenna monopoles are activated with progressive 90-degree phase shift, as discussed in co-pending U.S. patent application Ser. No. 11/527,355, "Switched Beam Forming Network For Amplitude Monopulse Directional And Omnidirectional Antenna," the disclosure of which is incorporated by reference herein in its entirety. In contrast, the TCAS regular transmit signal should in most cases be transmitted using a directional antenna radiation pattern. The directional TCAS transmit mode is provided by the alternate activation of one of the input/output ports 204A, 204B, 204C, or 204D of SBFN 203 with 0-degree phase shifter (see reference number 713, FIG. 7). For each input/output port there are different radiation lobes: 0 degrees, 90 degrees, 180 degrees and 270 degrees. Therefore, the antenna directional pattern position depends on which input/output port is activated. In the TCAS transmission mode, when SBFN 203 is activated through only one of the input/output ports 204A, 204B, 204C or 204D, only one of the four radiation lobes is present, thereby creating a directional radiation pattern. TCAS signals received from other aircraft are directional, and the relative signal intensity from four SBFN inputs/outputs 204A, 204B, 204C, 204D shows azimuth direction of the other aircraft. Specifically, comparing the signal intensities in the four receive channels electrically coupled to the four inputs/output ports of SBFN 203 enables a determination of the position of the other aircraft. Transponder and UAT signals received from other aircraft shall be processed through all four monopoles A1, A2, A3, A4 and passed down all four SBFN ports 204A, 204B, 204C, and 204D. During the omnidirectional Transponder, TCAS or UAT transmit mode, SBFN 203 provides simultaneous activation of the four antenna monopoles with progressive 90-degree phase shift of the four antenna monopoles. To eliminate the need for a special matching network, the matching of the antenna monopoles can be provided by modification of SBFN 203 as described in the aforementioned co-pending patent application.

Figure 3:
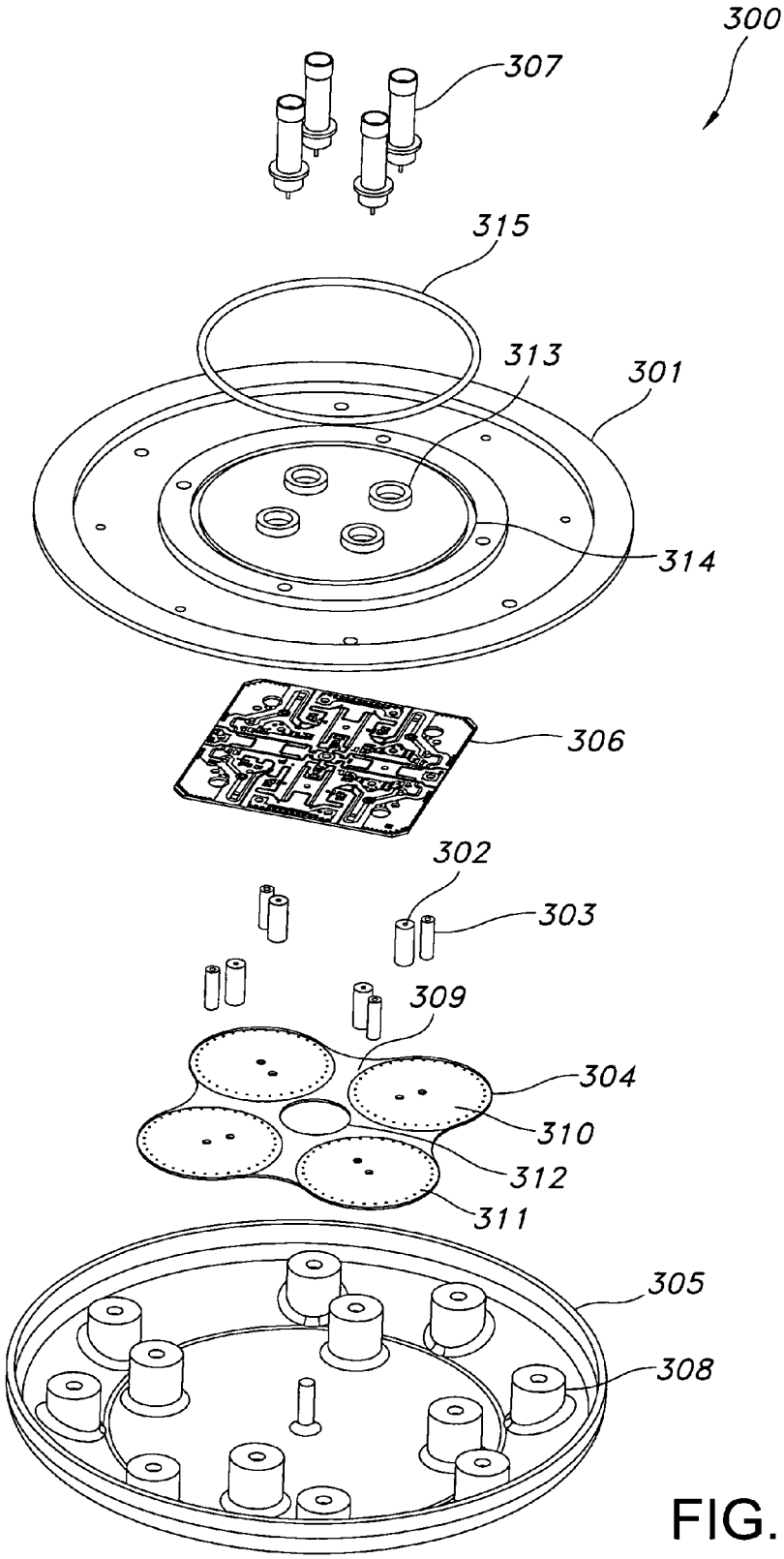
FIG. 3 is an exploded view of the antenna according to the invention.

FIG. 3 illustrates an exploded view 300 of the antenna 201 including a single metal base ground plate 301, feeding posts 302, shorting posts 303, a first printed circuit board (PCB) 304, an antenna radome 305, an SBFN card assembly 306, four electrical connectors 307, and fastening posts 308. First PCB 304 includes a thin dielectric substrate 309, for example G-10 material with thickness of 0.040 inches, with four coated two-side metallization copper capacitive hats 310. The two sides of each capacitive hat are electrically coupled through a plurality of through-hole metallization (vias) 311. Four feeding posts 302 are electrically coupled to the capacitive hats 310 on one side and to the antenna terminals of the SBFN on the other side. Each shorting post 303 is electrically coupled to one of the capacitive hats 310 on the one side and to the ground plate 301, through vias inside SBFN card assembly 306, on the other side. The shorting posts 303 reduce the overall size of said antenna. SBFN card assembly 306 preferably comprises a microstrip printed circuit board, a stripline printed circuit board, or a combination thereof, and may be realized by single-layer or multilayer construction.

Figure 7:
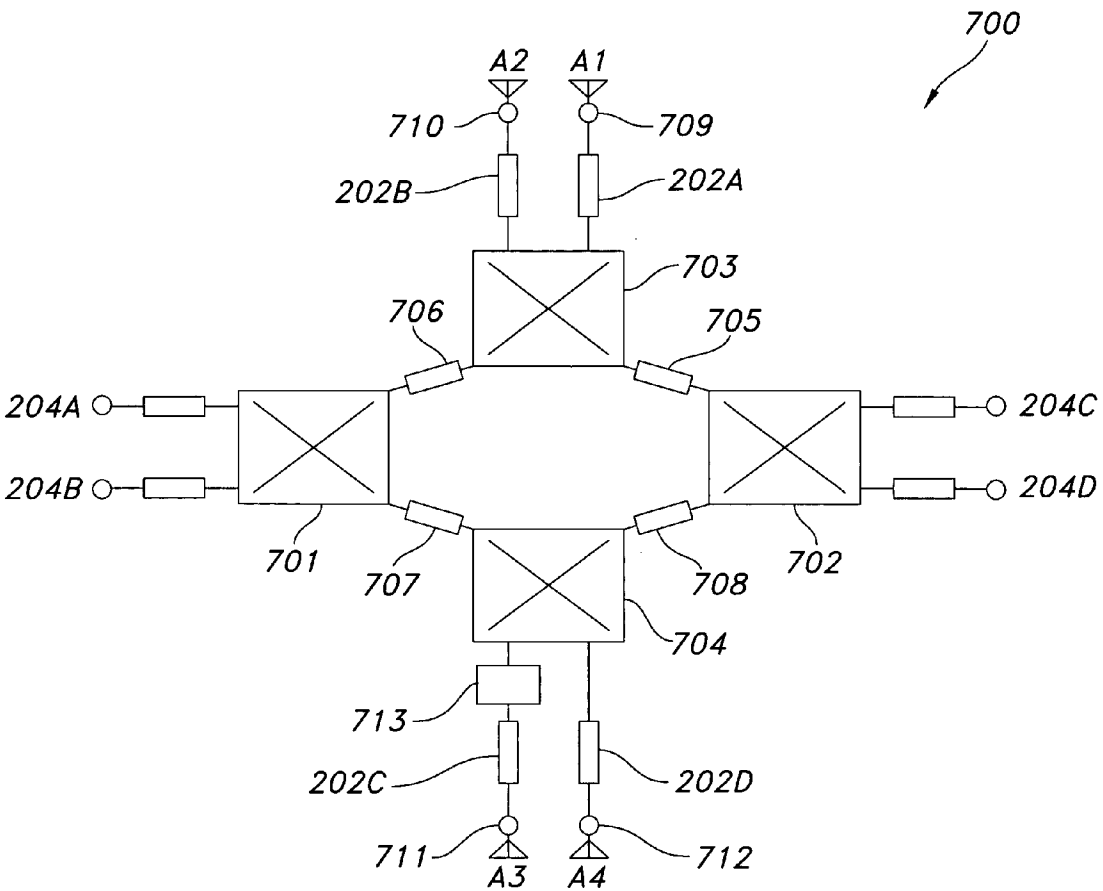
FIG. 7 is a functional block diagram illustrating a switched beam forming network according to the invention.

According to the disclosure of the above-mentioned co-pending U.S. Patent Application "Switched Beam Forming Network For Amplitude Monopulse Directional And Omnidirectional Antenna," and as depicted in FIG. 7 herein, the switched beam forming network 700 may include, for example, input/output ports 204A, 204B, 204C, 204D that are electrically coupled to a first set of 90-degree hybrids 701 and 702. First 90-degree hybrids 701, 702 are electrically coupled to a second set of 90-degree hybrids 703, 704 through quarter-wavelength transmission lines 705, 706, 707 and 708. 90-degree hybrid 703 is electrically coupled to antenna terminals 709, 710, through impedance matching elements 202A, 202B, respectively. 90-degree hybrid 704 is electrically coupled to antenna terminals 711, 712 through impedance matching elements 202C, 202D, respectively. Two closely spaced pairs of orthogonally positioned antenna monopoles A1, A2, A3, A4 are connected to antenna terminals 709-712. A switched 0-degree/180-degree phase shifter 713 is disposed between one antenna terminal 711 and a port of one of the 90-degree hybrids 704. When a directional antenna radiation pattern is desired, switched phase shifter 713 is in the zero-degree position. When an omnidirectional antenna radiation pattern is desired, switched phase shifter 713 is controlled to be in the 180-degree position. When a directional antenna pattern is desired, for example during a 1030 MHz TCAS regular transmit mode, switched phase shifter 713 provides zero phase shift, and the transmit signal passes alternately to only one input/output port 204A, 204B, 204C, 204D. When input/output port 204A is activated, the signal phases of antenna terminals 709-712 are 0, 270, 0, and 90 degrees, respectively, and the direction of the antenna radiation pattern is on the left position (left quadrant). When input/output port 204B is activated, the signal phases of input/output ports 709-712 are 90, 0, 270, and 0 degrees, respectively, and the direction of the antenna radiation pattern is oriented toward the front position. When input/output port 204C is activated, the signal phases of input/output ports 709-712 are 270, 0, 90, and 0 degrees, respectively, and the direction of the antenna radiation pattern is oriented toward the aft position. When input/output port 204D is activated, the signal phases are 0, 90, 0, and 270 degrees, respectively, and the direction of the antenna radiation pattern is oriented to the right. For the omnidirectional antenna mode, only one input/output port 204A or 204D should be activated, and a 180-degree phase shift should be provided by switched phase shifter 713 as previously discussed. In this case the progressive 90-degree phase shift at the antenna terminals is realized due to the antenna radiation pattern is omnidirectional. Switched Beam Forming Network 700 operates as further described in said co-pending patent application, and may include other electrical components and/or may be modified according to the embodiments disclosed in said co-pending patent application.

Returning to FIG. 3, SBFN card assembly 306 is electrically and mechanically coupled on one side to ground plate 301 and to feeding posts 302 and shorting posts 303 on the other side. The four electrical connectors 307 are electrically coupled to the four input/output ports 204A-D of SBFN card assembly 306 and to an aircraft electrical apparatus (not shown) through four coax cables (not shown). Fastening posts 308 with assembly screws (not shown) provide structure support for radome 305, additional isolation between the folded monopoles, and additional lightning protection. Radome 305 is mechanically coupled to ground plate 301. The ground plate 301 provides mechanical support for the components of the antenna 201. The ground plate 301 has raised bosses 313 that provide structural support for electrical connectors 307 as the electrical connectors pass through the ground plate 301. In addition, the ground plate has a circular groove 314 in which a gasket 315 resides. Gasket 315 provides an environmental seal between the antenna assembly 300 and the aircraft structure. First printed circuit board 304 has a through hole 312 in the center of dielectric substrate 309 to provide 90-degree beam width at a 3 dB level for the directional operation and optimum coupling between the individual folded monopoles. The ground plate 301 provides structural support for SBFN card assembly 306, the four connectors 307, and antenna radome 305.

Figure 4:
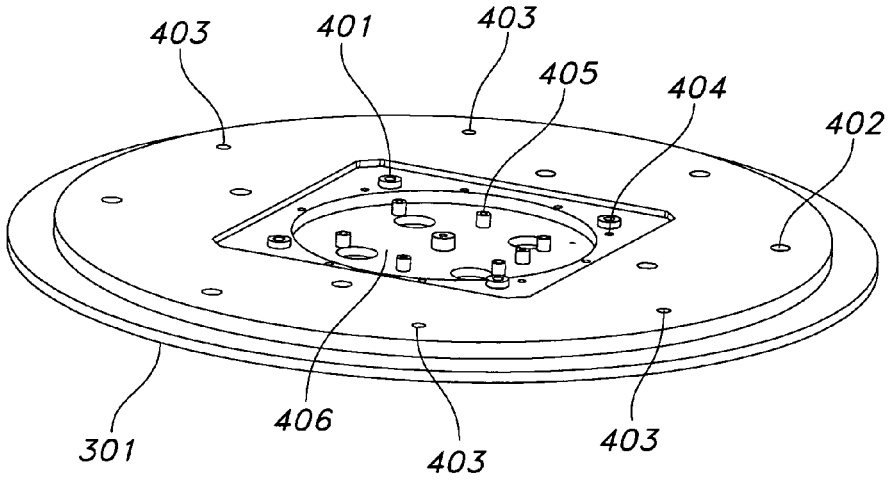
FIG. 4 is a top view of the single ground base plate.

FIG. 4 illustrates more details of ground plate 301. Specifically, FIG. 4 depicts the side of ground plate 301 not visible in FIG. 3. Ground plate 301 provides mechanical attach points 401 for the shorting posts 303 and mechanical attach points 402 for some of the fastening posts 308. The remainder of the fastening posts 308 provide attach points to the aircraft structure. Other mechanical attach points 403 enable the ground plate to be secured to radome 305 at final assembly. Ground plate 301 also includes mechanical attachment points 404 to mount SBFN card assembly 306 thereto. SBFN card assembly 306 is also mechanically attached to ground plate 301 using bosses 405. Bosses 405 provide an air space between SBFN card assembly 306, using, for example, a microstrip transmission line and an electrical ground by way of a recessed pocket 406. The mechanical assembly of ground plate 301 provides for a simple assembly sequence and reduces the cost of antenna 201.

Figure 5:
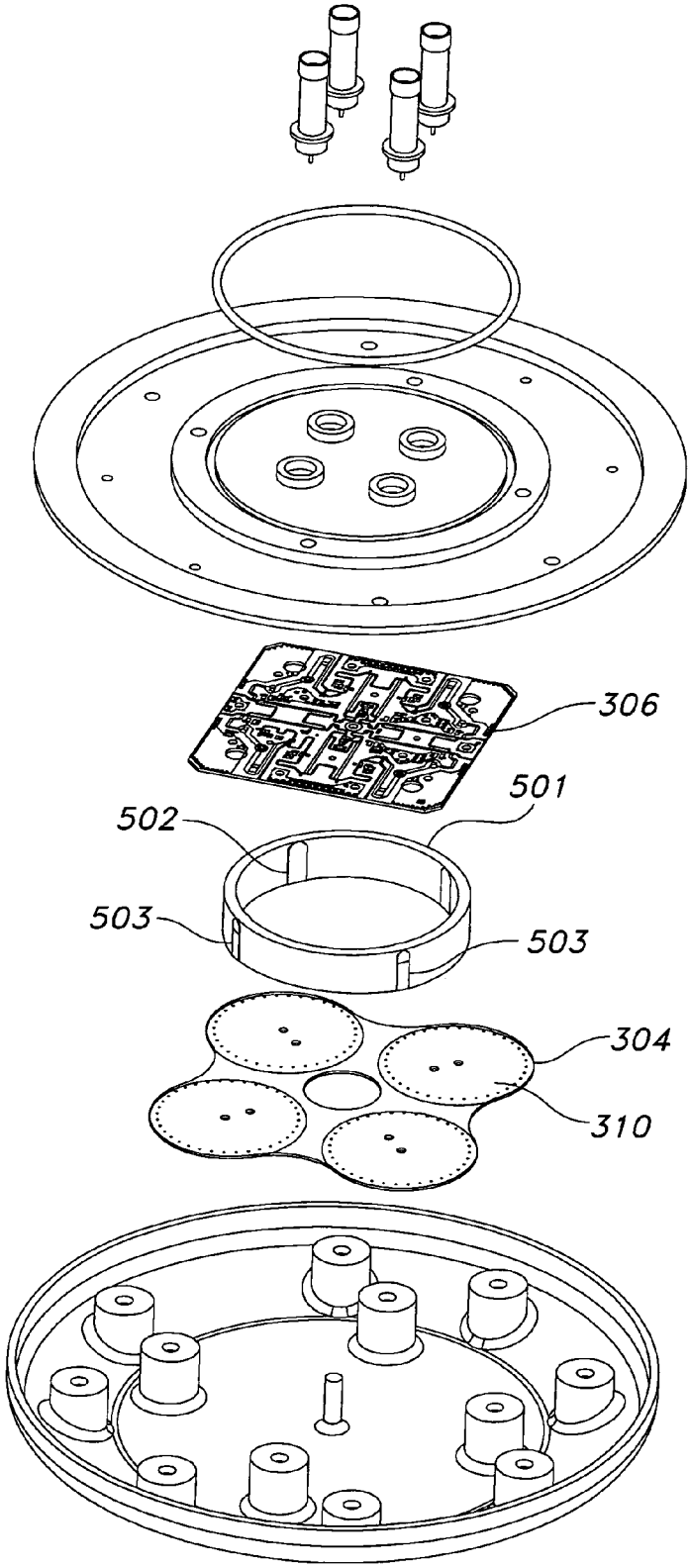
FIG. 5 is exploded view of the antenna using feeding and shorting strips on a hollow dielectric cylinder according to the invention.

FIG. 5 is an exploded view of antenna 201 according to another embodiment of the invention, in which feeding posts and shorting posts of the previous embodiments are replaced by a hollow dielectric ring or cylinder 501 with four feeding strips 502 and four shorting strips 503 printed thereon. Dielectric cylinder 501 is installed in the antenna center and is mechanically coupled to first PCB 304 and to SBFN card assembly 306. The diameter of dielectric cylinder 501 should be equal to the space between the diagonal monopoles. For structural support, an additional dielectric cylinder can be disposed inside the main hollow cylinder. The dielectric constant of the additional dielectric cylinder should be less than the dielectric constant of main cylinder 501. Each of the feeding strips 502 and shorting strips 503 are electrically coupled to one of four capacitive hats 310 on one end. The other end of each of the feeding strips is electrically coupled to the SBFN card assembly 306, and other end of each of the shorting strips are electrically coupled to the ground plate of SBFN card assembly 306. The space between the parallel feeding and shorting strips is equal to the thickness of the dielectric cylinder. The ratio between the feeding and shorting strip widths should be optimized to provide broad well-matched passband and greater antenna efficiency. To realize these advantages, the feeding strip width should be greater than the shorting strip width. The dielectric cylinder and the flat strip geometry permits more precise control of resonance frequency, ensures broad bandwidth for transmission and reception, allows for small antenna design, realizes stronger antenna assembly tolerances, and improves antenna performance without the use of additional tuning elements.

Figure 6:
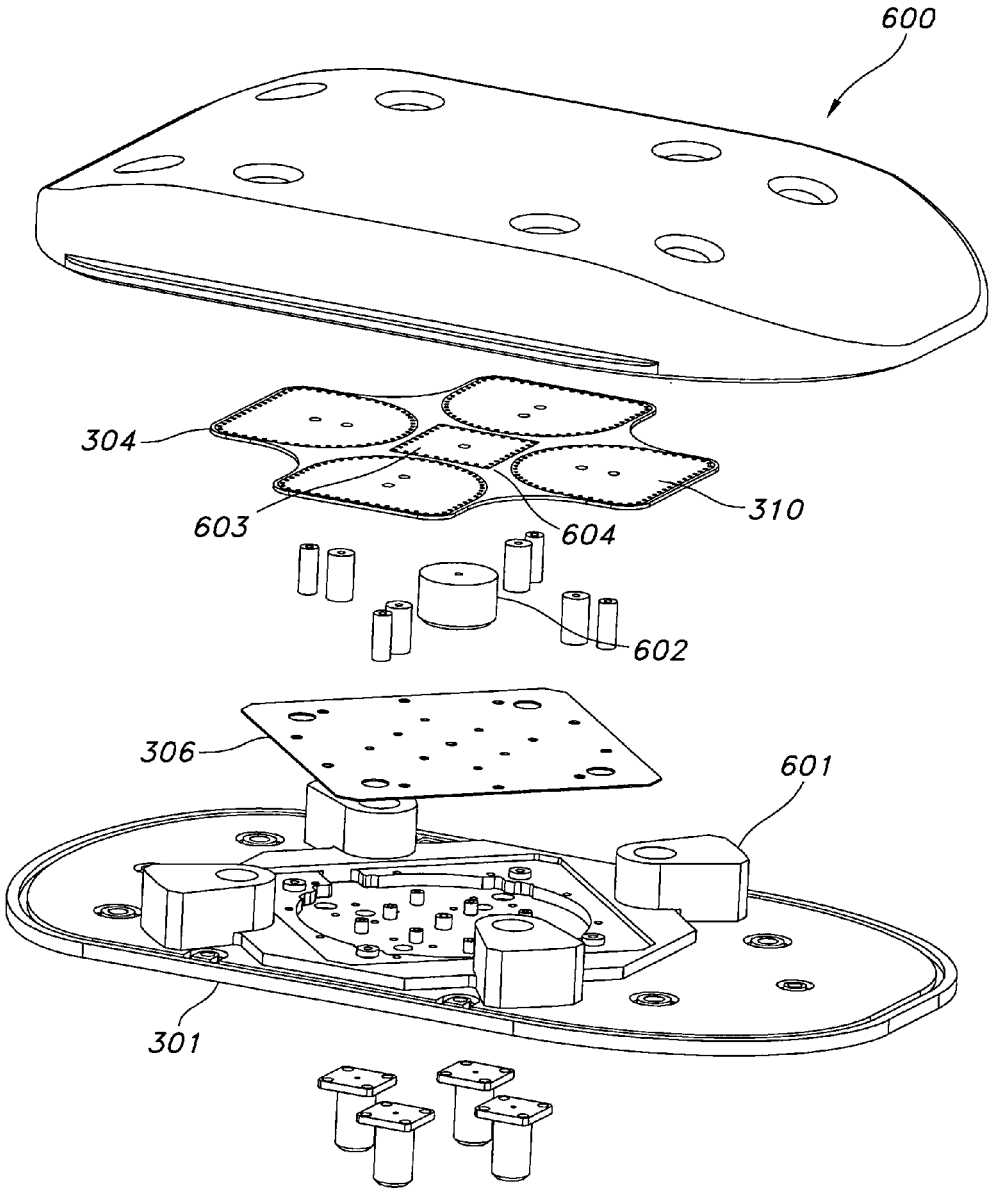
FIG. 6 is an exploded view of the antenna using decoupling elements according to the invention.

The limited space available results in small inter-monopole antenna spacing, which in turn leads to the existence of mutual coupling between antenna monopoles. The mutual coupling refers to the electromagnetic interactions between the monopoles of an antenna array. The mutual coupling causes an antenna pattern distortion, reduced radiation efficiency and effective gain. The amount of mutual coupling depends on the separation between antenna monopoles and the antenna array geometry. In order to minimize the coupling between the antenna monopoles, according to another embodiment of the invention depicted in FIG. 6 and indicated at reference number 600, decoupling elements 601, 602, 603 are installed between capacitive hats 310. Outside decoupling element 601 has a skirt shape and forms part of the antenna metal base ground plate 301. Decoupling element 602 is a center ground post that is preferably part of the antenna metal base plate 301, or may be a separate element as shown in FIG. 6, in which case it is grounded through vias in SBFN card assembly 306 to antenna metal base ground plate 301. The center ground post can be implemented as a round shape, as depicted in FIG. 6, but may also have a square cross-section. Decoupling element 603 is implemented as a printed square shape two-side metallization portion on first PCB 304. The two sides of decoupling element 603 are electrically coupled through a plurality of through-hole metallization (vias) 604. Decoupling element 603 has electrical contact with decoupling element 602, and therefore decoupling element 603 is grounded to metal base ground plate 601.

Figure 8:
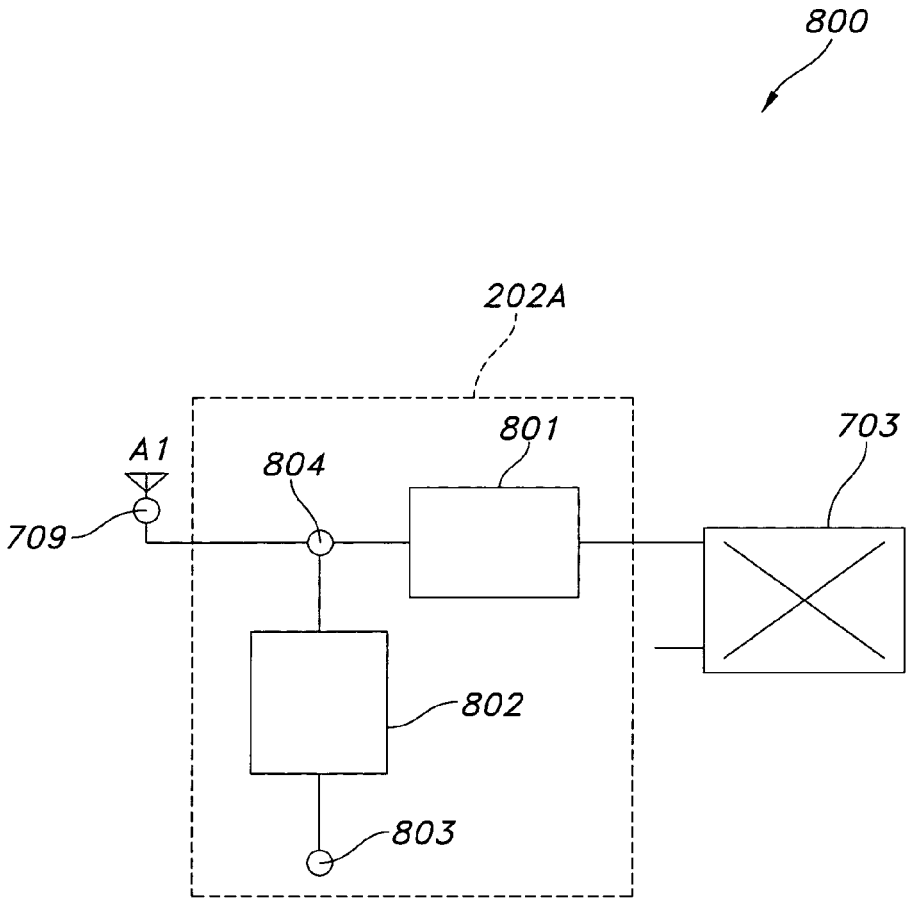
FIG. 8 is a functional block diagram illustrating a broadband matching network.

FIG. 8 illustrates an implementation of broadband matching network 202A according to another embodiment of the invention. Broadband matching network 202A includes a multistage transformer 801 and a stub 802 opened on one side 803 and connected in parallel at point 804 between multistage transformer 801 and an antenna terminal 709. Stub 802 is implemented as an opened low-pass filter. The four-step low-pass filter/opened stub provides 14 dB min return loss of the antenna inputs/outputs in the required frequency range from 978 MHz to 1090 MHz.

Figure 9:
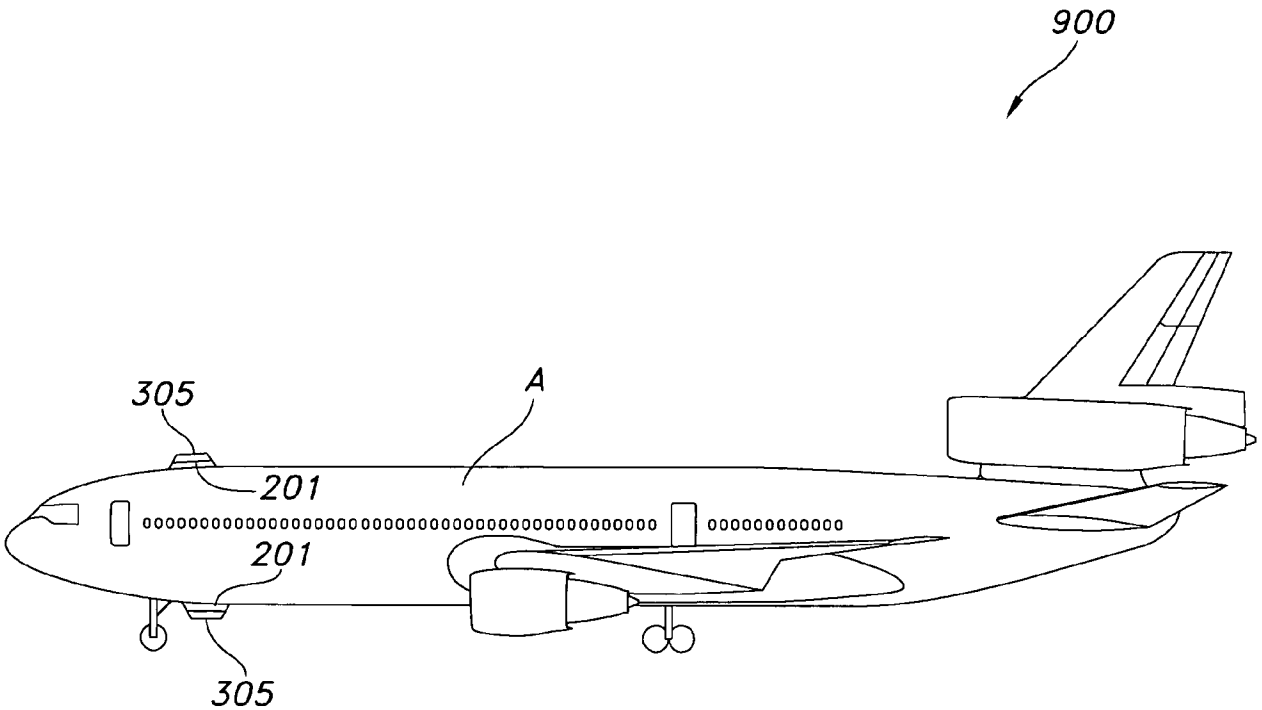
FIG. 9 is a side elevation view of an aircraft in which the invention has been implemented.

The invention has been described as an antenna system usable in directional and omnidirectional modes. The invention has especial utility in any situation where a lightweight, compact directional/omnidirectional antenna is desirable. One exemplary application is shown in FIG. 9, in which the antenna 201 may be installed in a radome 305 of an aircraft A. The radome may be disposed upon the top or the bottom of the fuselage of aircraft A, which are areas that not shielded from radar interrogation. The performance of the invention permits aircraft A to communicate using Transponder, UAT, and TCAS protocols. Of course, other applications and frequencies are within the scope of the invention.

The invention may be varied in many ways while keeping with the spirit and intent of the invention. For example, the hollow dielectric cylinders may have other shapes as desired. Also, hollow dielectric cylinder may be replaced by a solid, with feeding strips 502 and/or shorting strips 503 embedded therein.

An advantage of the invention is that the single ground plate design eliminates the need for machining multiple mechanical plates, as has been necessary for known directional antenna systems. The size and weight of the invented antenna is significantly reduced.

Another advantage is that the reduction in the number of mechanical plates reduces the cost of the system, as well as associated manufacturing requirements of the system.

Another advantage of the invention is that the antenna system may be advantageously used with a combined 4×4 hybrid matrix and switching network that requires no complicated architecture to transmit and receive in directional and omnidirectional modes. Such a combination further reduces size, weight, and complexity of an antenna system.

While the invention has been disclosed in its preferred form, the specific embodiments thereof as disclosed and illustrated herein are not to be considered in a limiting sense as numerous variations are possible. The subject matter of the invention includes all novel and non-obvious combinations and subcombinations of the various elements, features, functions and/or properties disclosed herein. No single feature, function, element or property of the disclosed embodiments is essential to all of the disclosed inventions. Similarly, where the claims recite "a" or "a first" element or the equivalent thereof, such claims should be understood to include incorporation of one or more such elements, neither requiring nor excluding two or more such elements.

It is believed that the following claims particularly point out certain combinations and subcombinations that are directed to the disclosed inventions and are novel and non-obvious. Inventions embodied in other combinations and subcombinations of features, functions, elements and/or properties may be claimed through amendment of the present claims or presentation of new claims in this or a related application. Such amended or new claims, whether they are directed to a different invention or directed to the same invention, whether different, broader, narrower or equal in scope to the original claims, are also regarded as included within the subject matter of the invention of the present disclosure.

What is claimed is:

1. An antenna system configured for selective directional and omnidirectional operation, comprising:

an array of folded monopoles;

a first printed circuit board having capacitive hats disposed thereon, each capacitive hat being in association with a folded monopole of the array of folded monopoles, the capacitive hats being formed by a coating on a dielectric substrate;

a second printed circuit board having a switched beam forming network formed thereon, the switched beam forming network configured to provide a predetermined omnidirectional antenna operation at a first switching position of the switched beam forming network and an activation of only one input/output port of the switched beam forming network, and a predetermined directional antenna operation at a second switching position of the switched beam forming network and an alternate activation of all inputs/output ports of the switched beam forming network;

an antenna radome;

a ground plate providing structural support for the switched beam forming network and the antenna radome;

a plurality of feeding elements, each feeding element of the plurality of feeding elements being associated with each monopole of the array of folded monopoles, said each feeding element being coupled to one of the capacitive hats and an antenna terminal of the switched beam forming network;

shorting elements of the folded monopoles coupled to the capacitive hats and to the ground plate; and a broadband matching network disposed between the folded monopoles and the input/output ports to provide matching therebetween.

2. The antenna system recited in claim 1, wherein the capacitive hats are coated on top and bottom sides of the first printed circuit board and are electrically coupled to each other by vias.

3. The antenna system recited in claim 1, wherein the first printed circuit board has a center through hole that provides a 90 degree beam width at a 3 dB level of an antenna directional pattern.

4. The antenna system recited in claim 1, wherein the switched beam forming network includes lines with modified impedances to provide matching between the folded monopoles and the antenna terminals without said matching network.

5. The antenna system recited in claim 1, wherein the ground plate is of a single, common construction.

6. The antenna system recited in claim 1, wherein the feeding and shorting elements are realized by whole metal cylindrical posts having diameters optimized to a desired antenna electrical performance.

7. The antenna system arrangement recited in claim 1, wherein the array of folded monopoles comprises four folded monopoles, and further wherein the switched beam forming network is a 4×4 hybrid matrix.

8. The antenna system recited in claim 1, wherein the feeding element and the shorting element associated with each folded monopole comprise parallel feeding and shorting strips disposed upon a hollow dielectric cylinder, the cylinder being interposed between and mechanically coupled to the first printed circuit board and the second printed circuit board, and wherein each feeding strip is electrically coupled to one of the capacitive hats and to one of the antenna terminals, and further wherein each shorting post is electrically coupled to one of the capacitive hats, and to a ground portion of the second printed circuit board and to the ground plate.

9. The antenna system recited in claim 8, wherein the hollow dielectric cylinder has a thickness, a height, a diameter, and a dielectric constant that are selected according to desired antenna electrical performance characteristics.

10. The antenna system recited in claim 8, wherein a width of each feeding strip is greater than a width of the shorting strip associated therewith, to thereby provide high antenna efficiency.

11. The antenna system recited in claim 8, wherein the antenna system includes four pairs of said parallel feeding and associated shorting strips.

12. The antenna system of claim 1, further including a plurality of grounded decoupling elements disposed between the capacitive hats.

13. The antenna system of claim 12, wherein the grounded decoupling elements are implemented in a metal skirt shape and are part of the ground plate.

14. The antenna system of claim 12, wherein the grounded decoupling elements include a center post configured to contact the first printed circuit board, the center post electrically connected to the ground plate.

15. The antenna system of claim 14, wherein the grounded decoupling elements further include a substantially square-shaped printed element formed by a coating upon a surface of the first printed circuit board, the printed element being connected to the ground plate through the center post.

16. The antenna system of claim 1, wherein the broadband matching network includes a multistage transformer and a shunt opened stub with a low-pass filter configuration connected in parallel between the multistage transformer and a folded monopole.

17. An aircraft antenna system configured for selective directional and omnidirectional operation, comprising:

an array of folded monopoles;

a first printed circuit board having capacitive hats disposed thereon, each capacitive hat being in association with a folded monopole of the array of folded monopoles;

a second printed circuit board having a switched beam forming network formed thereon, the switched beam forming network configured to provide a predetermined omnidirectional antenna operation at a first switching position of the switched beam forming network and an activation of only one input/output port of the switched beam forming network, and a predetermined directional antenna operation at a second switching position of the switched beam forming network and an alternate activation of all inputs/output ports of the switched beam forming network;

a plurality of feeding elements, each feeding element of the plurality of feeding elements being associated with each monopole of the array of folded monopoles, said each feeding element being coupled to one of the capacitive hats and an antenna terminal of the switched beam forming network;

shorting elements of the folded monopoles being coupled to the capacitive hats and to a ground plate of the antenna system; and an antenna radome, wherein the ground plate provides structural support for the switched beam forming network and the antenna radome.

18. The aircraft antenna system recited in claim 17, wherein the feeding element and the shorting element associated with each folded monopole comprise parallel feeding and shorting strips disposed upon a hollow dielectric cylinder, the cylinder being interposed between and mechanically coupled to the first printed circuit board and the second printed circuit board, and wherein each feeding strip is electrically coupled to one of the capacitive hats and to one of the antenna terminals, and further wherein each shorting post is electrically coupled to one of the capacitive hats, and to a ground portion of the second printed circuit board and to the ground plate.

19. An antenna system configured for selective directional and omnidirectional operation, comprising:

means for providing a plurality of folded monopoles;

means for connecting a capacitive hat to each of the plurality of folded monopoles;

means for providing an omnidirectional antenna radiation pattern and a directional antenna radiation pattern;

means for selectively switching between the omnidirectional antenna radiation pattern and the directional antenna radiation pattern;

means for associating an antenna terminal feeding element with each folded monopole and the respective capacitive hat; and ground plate means for providing structural support for the switched beam forming network and an antenna radome, wherein the feeding element and a shorting element associated therewith comprise parallel feeding and shorting strips disposed upon a dielectric means, the dielectric means being interposed between and mechanically coupled to the means for connecting the capacitive hat and to the means for providing an omnidirectional antenna radiation pattern and a directional antenna radiation pattern.

* * * * *